US009713813B2

(12) United States Patent
Ballhause

(10) Patent No.: US 9,713,813 B2
(45) Date of Patent: Jul. 25, 2017

(54) CENTRIFUGE CUP

(75) Inventor: Norman Ballhause, Windhausen (DE)

(73) Assignee: Thermo Electron LED GmbH, Langenselbold (DE)

( * ) Notice: Subject to any disclaimer, the term of this patent is extended or adjusted under 35 U.S.C. 154(b) by 322 days.

(21) Appl. No.: 12/491,584

(22) Filed: Jun. 25, 2009

(65) Prior Publication Data

US 2010/0004109 A1 Jan. 7, 2010

(30) Foreign Application Priority Data

Jul. 3, 2008 (DE) ..... 10 2008 031 502

(51) Int. Cl.

| | |
|---|---|
| ***B65D 45/14*** | (2006.01) |
| ***B04B 5/04*** | (2006.01) |
| ***B65D 45/20*** | (2006.01) |
| ***B65D 45/04*** | (2006.01) |

(52) U.S. Cl.

CPC ..... *B04B 5/0421* (2013.01); *B65D 45/04* (2013.01); *B65D 45/14* (2013.01); *B65D 45/20* (2013.01)

(58) Field of Classification Search

CPC .... B04B 5/0421; B65D 43/265; B65D 45/04; B65D 45/02; B65D 45/14; B65D 45/20; B65D 45/22

USPC ..... 220/212.5, 318, 324; 215/284, 285, 293, 215/280, 286; 292/194, 195, 197, 200, 292/240, 241, 256

See application file for complete search history.

(56) References Cited

U.S. PATENT DOCUMENTS

| | | | | | |
|---|---|---|---|---|---|
| 190,940 | A | * | 5/1877 | Weber | 215/316 |
| 353,503 | A | * | 11/1886 | Rehfuss | 215/286 |
| 912,095 | A | * | 2/1909 | Eason | 220/318 |
| 1,194,762 | A | * | 8/1916 | Matthias | 215/280 |
| 1,312,626 | A | * | 8/1919 | Grannis | 220/318 |
| 1,433,383 | A | * | 10/1922 | Klostermann et al. | 215/293 |
| 2,178,868 | A | * | 11/1939 | Bullock | 220/318 |

(Continued)

FOREIGN PATENT DOCUMENTS

| | | |
|---|---|---|
| DE | 84 15 715.1 U1 | 8/1984 |
| DE | 101 28 539 A1 | 1/2003 |

(Continued)

OTHER PUBLICATIONS

Japanese Patent Office, Office Action, Patent Application No. 2009-158438, dated Mar. 15, 2011 (3 pages).

(Continued)

*Primary Examiner* — James N Smalley

(74) *Attorney, Agent, or Firm* — Wood Herron & Evans LLP

(57) ABSTRACT

The invention relates to a centrifuge cup, which has a container and a cover. The cover has a lever including a guide element in each case on opposing edge areas thereof. The guide elements are able to be introduced into an associated guide path of the container by pivoting the lever. The guide elements are implemented in such a way that in a closed state of the cover with the container, a clamping force (F) having vertical force component ($F_y$) and horizontal force component ($F_x$) is provided at a contact point or a contact line of the guide elements with the particular associated guide path.

7 Claims, 5 Drawing Sheets

(56) References Cited

U.S. PATENT DOCUMENTS

| | | | | |
|---|---|---|---|---|
| 3,323,675 | A * | 6/1967 | Van Der Ham et al. | 220/4.02 |
| 3,635,370 | A | 1/1972 | Romanauskas | |
| 4,360,123 | A * | 11/1982 | Blease | 220/323 |
| 4,893,724 | A * | 1/1990 | Schiemann | 220/263 |
| 6,415,786 | B1 * | 7/2002 | Kolbe et al. | 128/200.24 |
| 7,246,718 | B2 * | 7/2007 | Einav et al. | 220/764 |
| 2005/0025674 | A1 | 2/2005 | Romanauskas et al. | |

FOREIGN PATENT DOCUMENTS

| | | | |
|---|---|---|---|
| DE | 20 2005 015 644 | U1 | 2/2007 |
| EP | 0 025 945 | A1 | 4/1981 |
| JP | 62-22948 | U | 2/1987 |

OTHER PUBLICATIONS

United Kingdom Intellectual Property Office, Patents Act 1977: Combined Search and Examination Report Under Sections 17 and 18(3), Application No. GB0910841.6, Date of Report Oct. 20, 2009, 5 pages.

* cited by examiner

CENTRIFUGE CUP

RELATED APPLICATION

The present application claims the priority under 35 U.S.C. §119 of German Patent Application No. 102008031502.8, filed Jul. 3, 2008, the disclosure of which is hereby incorporated herein by reference in its entirety.

FIELD OF THE INVENTION

The invention relates to a centrifuge cup, which has a container and a lid having a lever, the lever having a guide element in each case on opposing edge areas and the guide elements being able to be introduced into an associated guide path of the container by pivoting the lever.

BACKGROUND OF THE INVENTION

Centrifuge cups are known in the prior art in which an aerosol-tight closure of a cover with an associated container is achievable. A centrifuge cup having a catch connection is described in EP 0 025 945 A1. The catch connection has projections directed in opposite directions on both the upper peripheral edge of the centrifuge cup and also on the edge of the hood, which are engaged after the application of the cover. The upper opening of the centrifuge cup may have two opposing recesses in the side walls of the centrifuge cup, in which an associated tab of the hood engages. The tab is seated on the inner side of the recess to form a seal. The ridges situated on the outer side of the tab allow the hood to be grasped and removed. To open and lift off the cover of the centrifuge cup, the projections and/or tabs must be pressed inward, in order to disengage the catch connection and thus be able to lift off the cover. Depending on the frequency of the opening and closing of the closure device and depending on the force application, appearances of material fatigue may result over time, whereby the device no longer closes correctly and is leaky.

A centrifuge cup may also be designed in such a way that the cover is provided with a lid which has lateral guide elements, which engage in a guide path. The requirements for tolerances to be maintained in the parts to be engaged may be relatively high. A further disadvantage is that the manufacturing of the guide path is typically complex and costly. In addition, an operator must position cover and container precisely to one another, so that a need exists for improving the operability.

SUMMARY OF THE INVENTION

According to one aspect of the present invention, a centrifuge cup is provided in which a permanent aerosol-tight closure is ensured during a centrifuging procedure. The opening and closing of the centrifuge cup is to be able to be performed easily, the closure automatically assuming an optimum closing position. The centrifuge cup is to be producible cost-effectively and is only to have low requirements for manufacturing tolerances. Furthermore, the closure of the centrifuge cup is to act on the centrifuge cup container with a uniformly distributed closing force.

The centrifuge cup according to one embodiment of the present invention has a container and a cover having a lever, the lever being provided with a guide element in each case on opposing edge areas. The guide elements may be introduced into an associated guide path of the container by pivoting the lever, the guide elements being implemented in such a way that, in a closed state of the cover with the container, a clamping force having vertical and horizontal force components is provided at a contact point or a contact line of the guide elements with the particular associated guide path.

According to another aspect of the present invention, the cover is not only reliably pressed onto the container edge, but rather also held stably in the lateral direction. Lateral displacement is thus not possible even during centrifuging operation. Because the guide elements are held opposite to one another, the cover is drawn into a central position upon closing. Centering of the cover in relation to the container thus occurs automatically. In addition, a uniform closing force along the entire container edge may thus be achieved. The requirements for manufacturing tolerances are relatively low due to the automatic centering, so that cost-effective manufacturing is possible.

The guide elements are preferably implemented as conical in cross-section.

The conical geometry is simple to produce and has the reliable effect that a closing force not only exists in the vertical direction, but rather a force vector is also provided in the horizontal direction.

According to one embodiment of the invention, the guide elements are oriented in the direction toward the central axis of the lever. The guide elements thus do not protrude outward, so that the danger is low that other objects will be hooked unintentionally when handling the lever. This is true in the same way for the associated guide path, which is oriented toward the central axis of the container. The guide paths thus also do not protrude outward, so that in the event of use without a cover, these guide paths cannot form interfering projections.

The rotational axis of the lever is preferably situated in a central plane of the container. This causes a symmetrical construction, only one guide path being required in each case on one side of the centrifuge cup and only one lever being required for closing the cover. A further advantage is that it is possible to put on the cover independent of direction, because placement in the 0° location or 180° location is achievable as a result of the symmetry. This is similarly true for a round or a polygonal container.

If the guide element is situated in the central plane of the container in the closed cover position, a vertical pressure force acting symmetrically on the container is achieved. This supports the uniform closing force distribution along the container edge.

In one embodiment of the invention, the cover has at least one positioning element, which may be inserted in at least one recess of the container. A defined location of the cover relative to the container is already provided without a fixedly pressed-on cover. A pre-positioning of the cover relative to the container can thus be achieved. This is advantageous in particular with a round centrifuge cup, multiple closure positions also being able to be implemented using multiple positioning elements. The positioning element allows a formfitting connection and also represents a twist lock.

The cover or the container can have a catch cam, which can be engaged with the lever. Upon closing of the cover, the lever can engage on the catch cam and thus be locked. On the other hand, the lever can also be moved outward via the catch cam, so that a resistance is to be overcome upon closing and the operator perceptibly perceives that the lever has reached a closure position. The catch cam then forms an indicator for reaching a closure position of the lever.

The lever is preferably provided with a spacer cam, which may be positioned to the container so that the lever and the cover connected thereto are situated at a predetermined distance relative to the container. If a container partial vacuum exists or a container seal is glued to the cover, by corresponding positioning of the lever, the spacer cam may press on a part of the container in such a way that the cover is forced to lift off of the container. This causes forced ventilation.

The cover of the centrifuge cup according to the invention may at least partially have a concavely implemented surface. This is particularly advantageous for one-handed operation. The ball of a hand may be placed in the concave surface, so that the front bow of the lever is reachable using the fingertips. On the other hand, the fingertips may also be placed in the concave trough and the front bow of the lever may be grasped using the thumb. This allows simple handling when opening and lifting or when closing the cover.

BRIEF DESCRIPTION OF THE DRAWINGS

Embodiments of the invention are explained in greater detail hereafter on the basis of schematic drawings. In the figures.

DETAILED DESCRIPTION OF THE INVENTION

Figure 1:
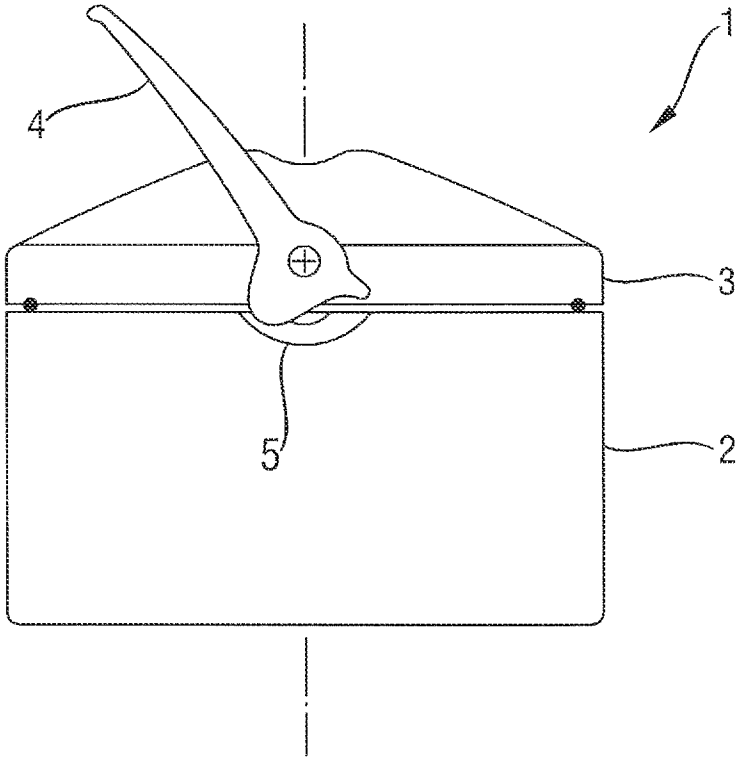
FIG. 1 shows a schematic illustration of a centrifuge cup in a side view according to a first embodiment, the lever being situated in a first position.
Figure 2:
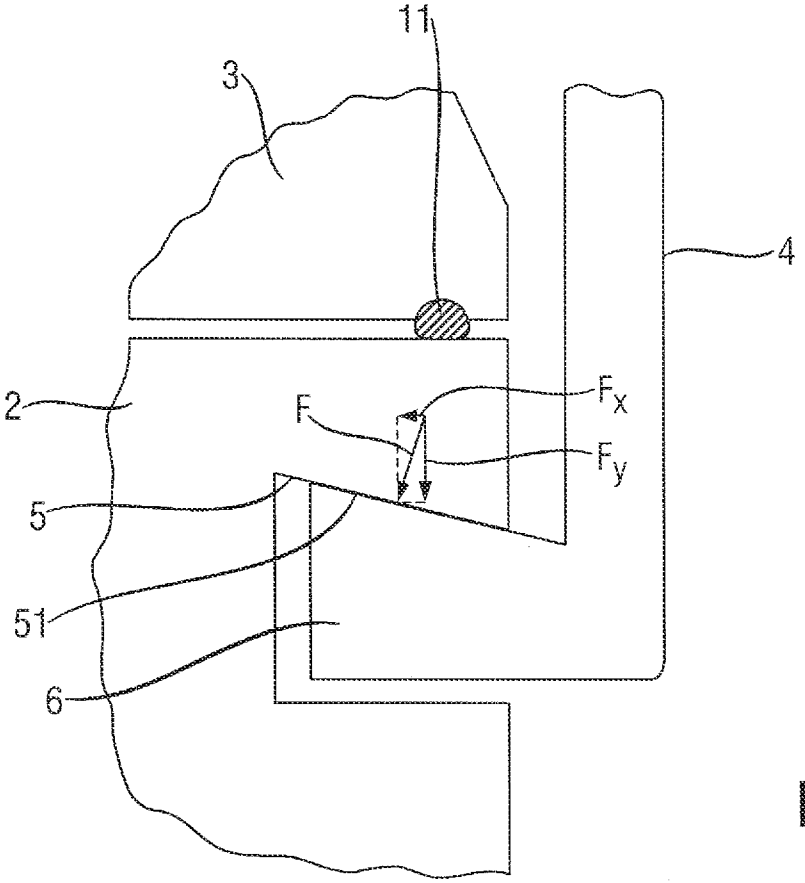
FIG. 2 shows a cross-sectional view in the area of the transition between cover and container in the first embodiment of the centrifuge cup.

According to FIG. 1, the centrifuge cup 1 according to one embodiment of the present invention has a container 2 and a cover 3. The cover 3 has a lever 4 which is used so that the cover 3 can be closed with the container 2. It is to be noted that the first embodiment shown in FIG. 1 is a centrifuge cup implemented as round, although a centrifuge cup implemented as rectangular may also be provided with the closure explained hereafter. The lever 4 has a guide element 6 in each case on opposing sides and/or edge areas which may be introduced into a guide path 5 of the container 2 by pivoting the lever 4 (see FIG. 2).

The centrifuge cup 1 is provided with guide elements 6, which are implemented as essentially conical in cross-section. The geometry may be derived from a right circular cone (in cross-section as a so-called dovetail) or an oblique circular cone (see FIG. 2). The conical guide element 6 is shaped in such a way that an undercut is achieved with the guide path 5, which is also implemented as a conical groove. The guide path 5 thus forms a buttress. At the contact line 51 between guide path and guide element, a clamping force or contact pressure force F acts, which has a horizontal component $F_x$ and a vertical component $F_y$. The vertical component $F_y$ is directed downward and causes the cover 3 and/or the seal 11 to be pressed against the container 2. A horizontal component $F_x$ is oriented in the direction toward the central axis of the lever 4, which acts on the guide element 6 oriented in the direction toward the central axis of the lever 4. Because these force conditions exist on both sides of the lever, the lever and thus the cover is oriented in a central position relative to the container 2 during the closing procedure. The guide element 6, instead of the conical geometry, may also have a similar geometry in cross-section, which may form a buttress with a correspondingly implemented guide path. The contact line 51 may thus run linearly, curved inward (concave), or curved outward (convex).

Figure 3:
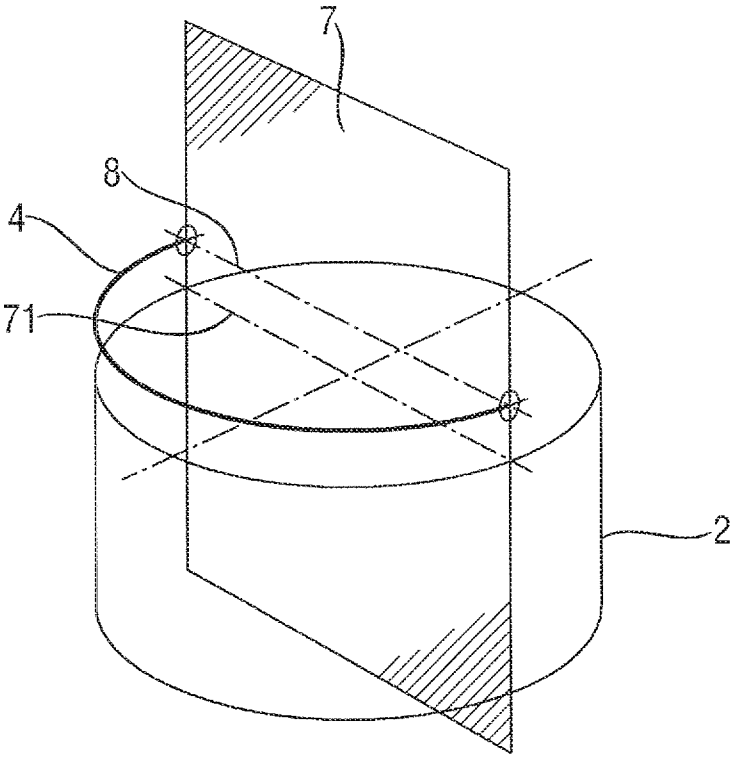
FIG. 3 shows a schematic illustration of the relative positions of the centrifuge cup and the rotational axis of the cover lever.

FIG. 3 schematically shows a perspective view of the container 2 and an associated central plane 7 of the container 2. The central plane 7 runs through the line of symmetry 71 of the container 2. The rotational axis 8 of the lever 4, which is shown in FIG. 3 in a closure position, runs in this central plane 7. In this way, the cover 3 may be put on the container 2 in a 0° position or a 180° position. Therefore, only one lever and also only one guide path is needed in each case on one container side, in order to close the cover 3 with the container 2.

Figure 4:
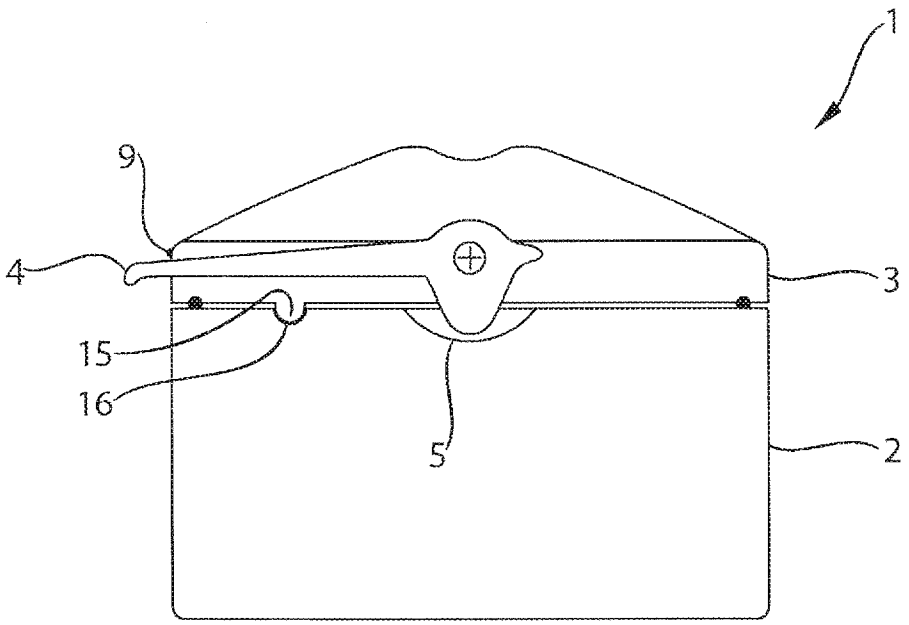
FIG. 4 shows a schematic illustration of the centrifuge cup in a side view according to a second embodiment, the lever being situated in a second position.

The location of the lever 4 shown in FIG. 3 is also recognizable in a side view in FIG. 4. In the event of a displacement of the lever 4 from the first position shown in FIG. 1 into a second position shown in FIG. 4, not only the guide elements 6 engage with the associated guide paths 5. In addition, in the embodiment shown in FIG. 4, a catch cam 9 is attached on the cover 3, which slightly brakes the displacement of the lever 4 into the second position. The lever 4, made of a sufficiently elastic plastic, must be elongated somewhat upon the displacement from the first position into the second position, in order to overcome the resistance occurring upon passing the catch cam 9. An operator may perceive this resistance and thus recognizes that after overcoming the catch cam 9, the lever 4 has reached a secure second position and/or a closure position. In addition, as an aid for the pre-positioning, a positioning element 15 may be attached on the cover 3, which engages in a recess 16 on the container and contributes to avoiding slipping during the closing procedure.

Figure 5:
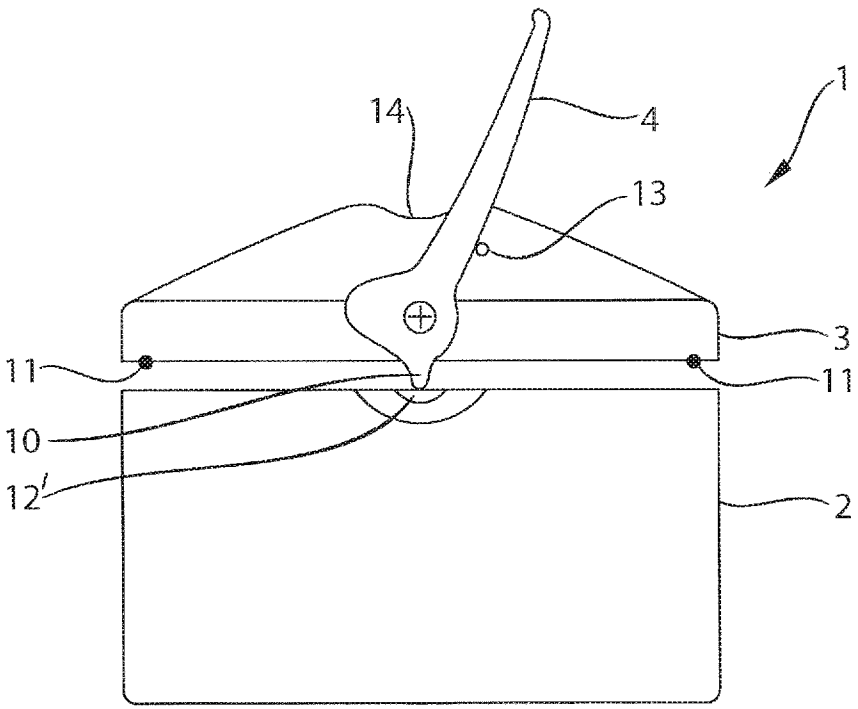
FIG. 5 shows a schematic illustration of the centrifuge cup in a side view according to a third embodiment, the lever being situated in a third position.

Upon pivoting of the lever 4 from the second position into the first position, it may occur that the lever 3 does not move away from the container 2. Causes for this could be, for example, a partial vacuum in the container 2 or a stuck seal 11 of the cover 3. In order to reliably remove the cover 3 from the container 2, in a further embodiment, the lever has a spacer cam 10, which engages with a contact face 12 of the container 2 when the lever 4 is displaced from the first position into a third position (see FIG. 5). The lever 4 may strike a stop 13 shortly thereafter, so that the lever is positioned in a rest location. The spacer cam 10 causes positive guiding of the cover 3, so that the cover 3 moves away from the container 2.

The operation of the lever may be made easier if the cover 3 has a concave surface 14. The ball of a hand may be placed in this concave surface, so that the lever 4 may be displaced in the direction of the closure position using the fingers. The concave surface 14 is implemented as ergonomic so that the operation of the lever and/or the centrifuge cup is made easier.

What is claimed is:

1. A centrifuge cup, comprising:

a container having a side wall including an outer surface, a central axis and a cover having a lever, the lever having a rotational axis and a guide element on opposing edge areas, the guide elements being able to be introduced into an associated guide path formed in the side wall of the container by pivoting the lever, wherein the guide path comprises a groove extending inwardly from the outer surface and into the side wall of the container in a direction toward the central axis so as not to protrude outward of the outer surface of the container, wherein the guide elements are implemented so that, in a closed state of the cover with the container, a clamping force (F) having vertical force component ($F_y$) and horizontal force component ($F_x$) is provided at a contact point or a contact line of the guide elements with the associated guide path, wherein the guide elements extend radially inward toward each other, and further wherein the container has a constant cross-sectional width along a height of the side wall of the container.

2. The centrifuge cup according to claim 1, wherein the rotational axis of the lever is situated in a central plane of the container.

3. The centrifuge cup according to claim 1, wherein the guide elements are situated in a central plane of the container in the closed state of the cover.

4. The centrifuge cup according to claim 1, wherein the cover has at least one positioning element which may be inserted in at least one recess of the container.

5. The centrifuge cup according to claim 1, wherein the cover or the container has a catch cam which can be engaged with the lever.

6. The centrifuge cup according to claim 1, wherein the lever is provided with a spacer cam, which can be positioned in relation to the container so that the lever and the cover connected thereto are situated at a predetermined distance relative to the container.

7. The centrifuge cup according to claim 1, wherein the cover at least partially has a concavely implemented surface.

* * * * *